US007218238B2

(12) United States Patent
Right et al.

(10) Patent No.: US 7,218,238 B2
(45) Date of Patent: May 15, 2007

(54) FIRE ALARM SYSTEM WITH METHOD OF BUILDING OCCUPANT EVACUATION

(75) Inventors: Robert Right, Bradenton Beach, FL (US); Hilario Costa, Myakka, FL (US)

(73) Assignee: Edwards Systems Technology, Inc., Cheshire, CT (US)

( * ) Notice: Subject to any disclaimer, the term of this patent is extended or adjusted under 35 U.S.C. 154(b) by 80 days.

(21) Appl. No.: 10/948,149

(22) Filed: Sep. 24, 2004

(65) Prior Publication Data

US 2006/0071802 A1 Apr. 6, 2006

(51) Int. Cl.
*G08B 17/10* (2006.01)

(52) U.S. Cl. ..... 340/628; 340/286.05; 340/332

(58) Field of Classification Search ..... 340/628
See application file for complete search history.

(56) References Cited

U.S. PATENT DOCUMENTS 4,754,266 A * 6/1988 Shand et al. ..... 340/691.2
4,801,928 A * 1/1989 Minter ..... 340/332
4,988,988 A * 1/1991 Kimura ..... 340/538
5,572,183 A * 11/1996 Sweeney ..... 340/332
5,654,690 A * 8/1997 Ishikawa et al. ..... 340/506
5,815,068 A * 9/1998 Vadseth ..... 340/332
5,905,438 A * 5/1999 Weiss et al. ..... 340/539.1
6,195,003 B1 * 2/2001 Ichikawa et al. ..... 340/505
6,201,470 B1 3/2001 Withington ..... 340/384.7
6,239,697 B1 * 5/2001 Murao ..... 340/505
6,317,042 B1 * 11/2001 Engelhorn et al. ..... 340/539.16
6,472,980 B1 * 10/2002 Jen et al. ..... 340/506
6,529,128 B2 * 3/2003 Weng ..... 340/506
6,535,121 B2 * 3/2003 Matheny ..... 340/506
6,693,532 B2 * 2/2004 Capowski et al. ..... 340/506
6,778,071 B2 * 8/2004 Megerle ..... 340/825.49
6,784,798 B2 * 8/2004 Morris ..... 340/628
6,914,534 B2 * 7/2005 Tanguay ..... 340/628
6,960,987 B2 * 11/2005 Dohi et al. ..... 340/286.05

* cited by examiner

*Primary Examiner*—Daniel Wu
*Assistant Examiner*—Eric M. Blount
(74) *Attorney, Agent, or Firm*—Baker & Hostetler LLP

(57) ABSTRACT

A fire alarm system is provided including a controller having a signaling delay, a plurality of smoke and/or heat detectors, a plurality of audible devices which may include sirens, public announcement devices and the like, and a plurality of visible devices which may include strobes, fluorescent lighting and the like. The system provides a directional path to areas of safety for occupants in harms way.

20 Claims, 3 Drawing Sheets

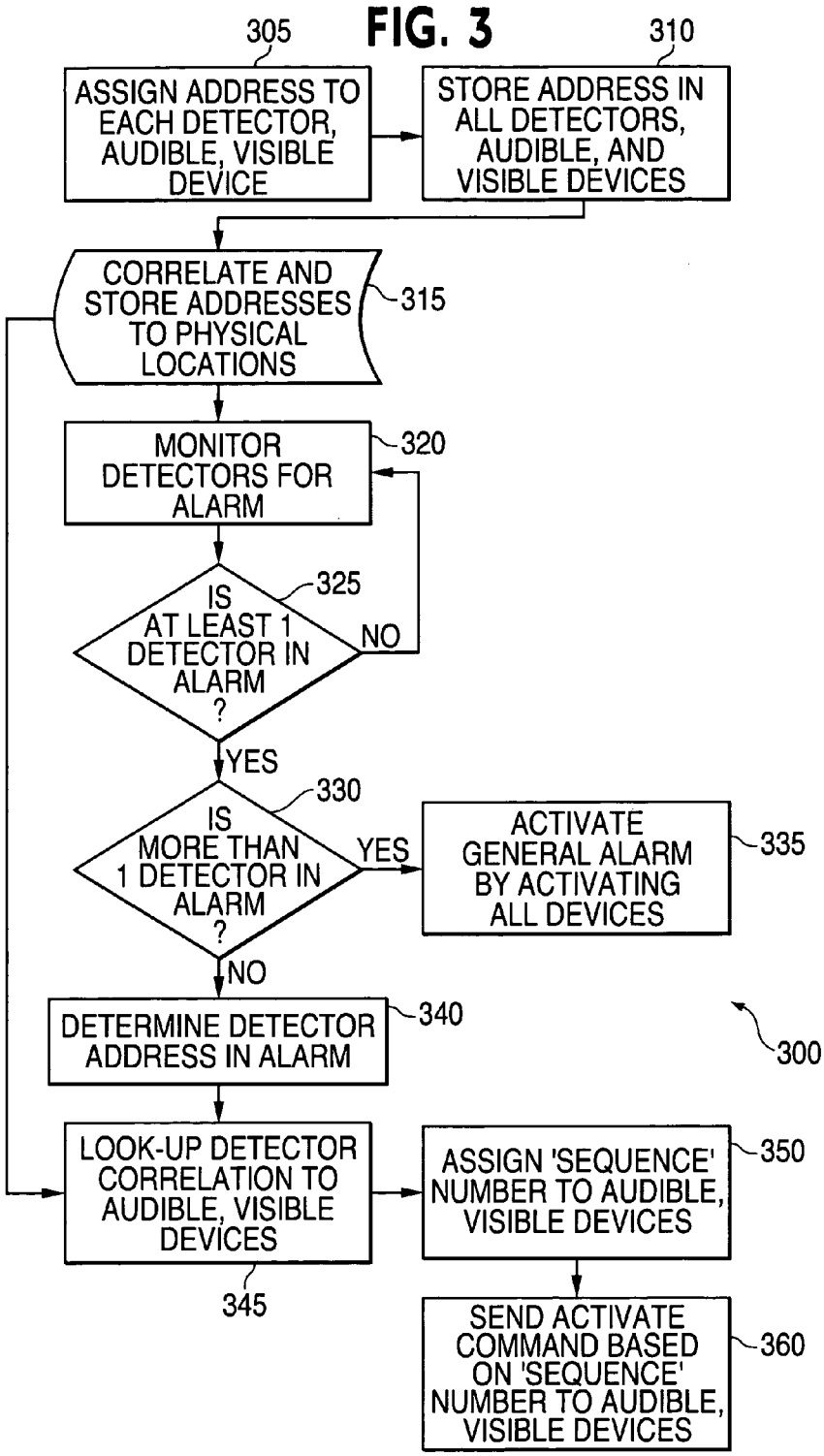
FIG. 3
305
ASSIGN ADDRESS TO EACH DETECTOR, AUDIBLE, VISIBLE DEVICE
310
STORE ADDRESS IN ALL DETECTORS, AUDIBLE, AND VISIBLE DEVICES
CORRELATE AND STORE ADDRESSES TO PHYSICAL LOCATIONS
315
MONITOR DETECTORS FOR ALARM
320
IS AT LEAST 1 DETECTOR IN ALARM ?
325
NO
YES
IS MORE THAN 1 DETECTOR IN ALARM ?
330
YES
ACTIVATE GENERAL ALARM BY ACTIVATING ALL DEVICES
335
NO
DETERMINE DETECTOR ADDRESS IN ALARM
340
300
LOOK-UP DETECTOR CORRELATION TO AUDIBLE, VISIBLE DEVICES
345
ASSIGN 'SEQUENCE' NUMBER TO AUDIBLE, VISIBLE DEVICES
350
SEND ACTIVATE COMMAND BASED ON 'SEQUENCE' NUMBER TO AUDIBLE, VISIBLE DEVICES
360

FIRE ALARM SYSTEM WITH METHOD OF BUILDING OCCUPANT EVACUATION

FIELD OF THE INVENTION

The present invention generally relates to a building fire alarm evacuation system for alerting individuals within a protected area of the presence of an emergency situation. More particularly, the present invention relates to the interaction of smoke detectors within the protected premise and audible and visible notification devices located within the protected premise, in which the activation of both the audible and visible devices are sequenced in a predefined pattern in response to the activation of the smoke detector. The sequence of sound and light patterns guide occupants to areas of safety in low/no visibility conditions.

BACKGROUND OF THE INVENTION

Fire alarm systems used in buildings and such are designed to save lives and comprise a number of components including devices such as smoke and heat sensors, and audible and visible indicators.

Indicators range from audio devices such as speakers, bells, horns, and sirens to visual devices such as incandescent lights, strobe lights, and illuminated exit signs.

For instance, prior art consists of a number of horns, sirens, bells, or voice message devices, which are strategically placed throughout a building and connected to the control panel of the fire alarm system. Upon the detection of smoke or fire, the audible device would activate and serve as an audible indicator of an emergency situation.

Alerting technology may incorporate the use of a strobe light, and like the audible device, is connected to the fire alarm control system and functions to serve as a visual indicator of an emergency situation.

The strobe light, however, has a different impact than that of the audible device. For example, the strobe light is better able to notify those with a hearing disability about the presence of an emergency. Furthermore, the light is effective in nighttime situations especially when the individual is outside the audible device's range. This is especially true when the audible device malfunctions and is unable to produce an audible sound. As a result of the mechanical failure possibility, many fire alarm systems incorporate a strobe light serving the dual purpose as detailed. In fact, many local towns or municipalities have mandated by law the use of both strobes and audible devices to alert individuals as to an emergency.

Placement of the devices in a building is generally determined by a variety of factors such as floor plans, hallways and room locations, elevator locations, exit locations, fire walls, etc. For instance, some buildings have a greater capacity to deliver sound, or reflect the strobe light based upon the buildings interior make-up.

The operating characteristics of audible and visual signals determine how occupants will hear and see them. These characteristics include the sound intensity and frequency, color of light and its intensity, flash duration, and flash repetition rate. Different buildings and environments require different needs.

The primary purpose of the fire alarm system is to alert the occupants and evacuate or lead them to safety. Sounding a general alarm tone or pre-recorded voice message accompanied with flashing lights may accomplish this goal in good visibility, but in cases where visibility is impaired or non-existent, it may not.

For example, an occupant of a hotel room may hear an evacuation signal in the middle of the night, open the room door, and must decide to take a left or right down the hallway to get to safety and has a fifty percent chance that he will select the correct direction. If he chooses the wrong direction, he may lead directly to the fire. A wrong decision may lead to toxic exposure and be fatal. When visibility is reduced or non-existent due to airborne particulates of combustion, the situation is more critical and a timely direct path to egress is monumental.

Accordingly, it is desirable to provide a method and apparatus that indicate a direct and timely path of egress in an emergency situation.

SUMMARY OF THE INVENTION

The foregoing needs are met, to a great extent, by the present invention, wherein in one aspect an apparatus is provided that in some embodiments provides a direct and timely path of egress in an emergency situation.

In accordance with one aspect of the present invention, a fire alarm system is provided, comprising a controller; a plurality of detectors; a plurality of audible devices; and a plurality of visible devices, wherein the controller is electrically connected to the detectors and controls the audible devices and the visible devices. The fire alarm system also includes the controller having memory and a delay control.

In accordance with another aspect of the present invention, a method of controlling a fire alarm system is provided comprising assigning an address to each of a plurality of detectors, audible devices and visible devices; storing said address of each detector, audible device and visible device; correlating each stored addresses to a physical location; activating a general alarm on each audible device and each visible device; determining activated detector's address and physical location; determining correlation of activated detector in proximity to each audible device and each visible device; assigning a sequence number to each audible device and each visible device; and activating each audible device and visible device according to their sequence number.

In accordance with still another aspect of the present invention, a fire alarm system is provided, comprising means for assigning an address to each of a plurality of detectors, audible devices and visible devices; means for storing said address of each detector, audible device and visible device; means for correlating each stored addresses to a physical location; means for activating a general alarm on each audible device and each visible device; means for determining activated detector's address and physical location; means for determining correlation of activated detector in proximity to each audible device and each visible device; means for assigning a sequence number to each audible device and each visible device; and means for activating each audible device and each visible device according to their sequence number.

Therefore, there is a need for a fire alarm system, which incorporates the use of an addressable fire detector, and an addressable audio and visual alert system that provides the occupant a directional path to areas of safety including other rooms, floors, or exits. The path may be dynamic and dependant on the initial fire location, and may direct occupants away from the fire origin to areas of safety.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 3 is flowchart illustrating steps that may be followed in accordance with the preferred embodiment of FIG. 1.

DETAILED DESCRIPTION

Figure 1:
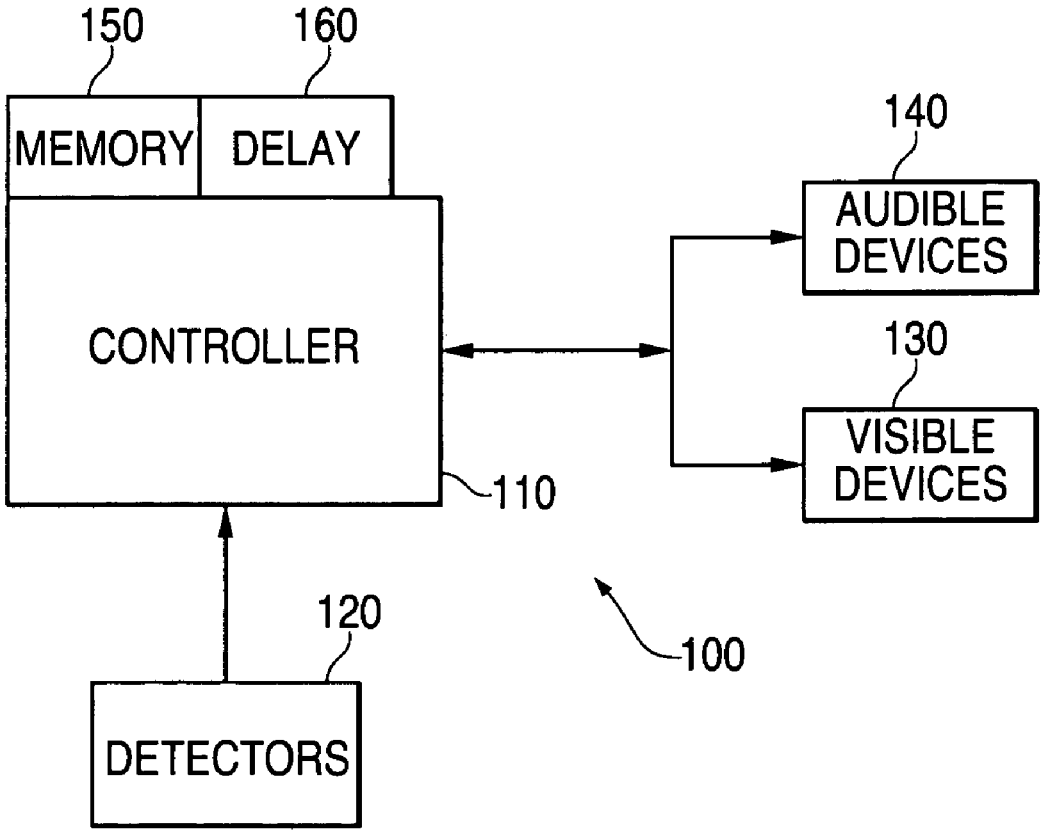
FIG. 1 is a diagrammatic representation of the detection and control system according to a preferred embodiment of the invention.

The invention will now be described with reference to the drawing figures, in which like reference numerals refer to like parts throughout. Referring to FIG. 1, an embodiment in accordance with the present invention provides a controller 110 having a signaling delay control 160 and controller memory 150, a plurality of smoke and/or heat detectors 120, a plurality of audible devices 140 which may include sirens, preferably, or public announcement (PA) devices and the like, and a plurality of visible devices 130 which may include strobes, preferably, or fluorescent lighting and the like. The signaling delay control 160 may be configured to time the sequence of activation for the audible devices 140 and/or the visible devices 130. The present invention is a fire alarm system 100, which incorporates the use of a plurality of addressable smoke and/or heat detectors 120, and an addressable audio devices 140 and visual alert devices 130 that provides the occupant a directional path to areas of safety including other rooms, floors, or exits. The path may be dynamic and dependant on the initial fire location, and may direct occupants away from the fire origin to areas of safety as an alarm situation progresses or intensifies The addressable feature of the smoke and/or heat detectors 120 and the audible devices 140 and visible devices 130 provides the ability to assign an address and thereby even a physical location to each. This assigned address and physical location can be stored in the controller memory 150 for later access and processing upon an alarm situation being detected or present.

The fire alarm system 100 has the capability and configuration to locate the actual fire hazard distinctly and directly. Fire alarm system 100 can also direct the egress evacuation to a safe location away from the detected fire hazard location in a clear and distinct manner via the audible devices 140 and visible devices 130 sequencing away from the direction of possible harm or fire. The fire alarm system 100 has the ability to react and be dynamic as the dynamics of the fire hazard changes or grows in order to direct occupants to safety.

Figure 2:
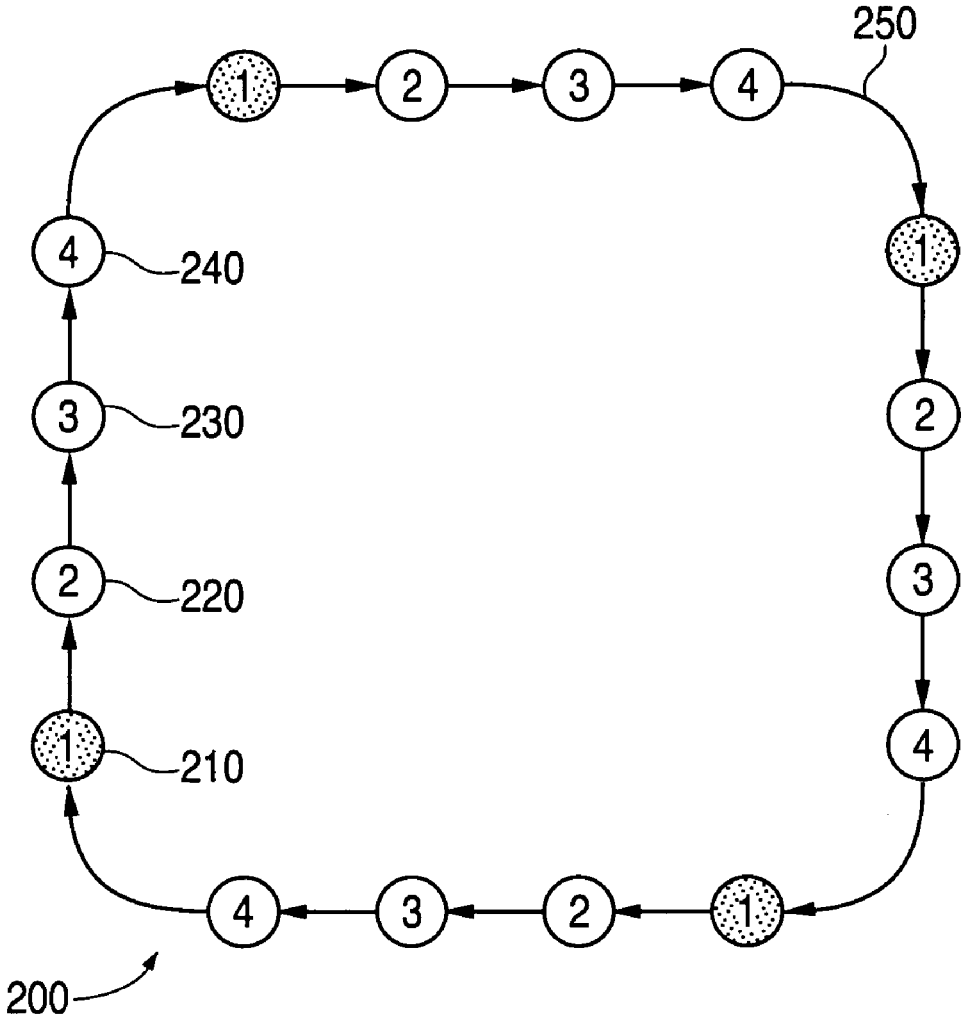
FIG. 2 is a diagrammatic representation illustrating the sequential signal flow from one alarm device to another thereby creating a virtual directional motion according to FIG. 1.

Referring to FIGS. 2 and 3, in accordance with one embodiment of the present invention, a combination smoke and/or heat detector devices 120, and a visual alarm signaling device 130, and an audible alarm signaling device 140, is installed at strategic locations 210, 220, 230, 240. These locations 210, 220, 230, 240 may be in proximity to an exit or exits as needed. The smoke/heat detector devices 120 are assigned a unique identity or address 305 that indicates it's physical location 315 to the controller 110. Similarly, the audible devices 140 and visual devices 130 are each assigned a unique identity 305 that allows an electrical signal or command to be sent from the controller 110 to activate the devices 130, 140 accordingly. When smoke or fire detectors 120 are activated, the controller 110 determines the location 210, 220, 230, 240, defines the path of exit 250, compiles the sequence of commands 350, 360 to be sent to the audible devices 140 and visible devices 130 which in turn lays out the path 250, audibly and visibly, of egress to the occupant(s) in the protected area.

The basis for providing the illusion of directional movement for the audible devices 140 and visible devices 130 can best be demonstrated in FIG. 2. In this example, each circle represents a single location 210, 220, 230, 240 and would represent an addressable audible device 140 and an addressable visible device 130, or may be either as well. If a command is sent to all the devices 130, 140 at location 210, followed by a delay signal 160, followed by a command 335 sent to all devices 130, 140 at location 220, and so on, the perception of rotational movement is created, similar to a marquis sign. This same principle applies to hallways, open areas, etc.

Referring to FIG. 3, in operation, the control process 300 assigns an address 305 to each detector 120, audible device 140 and/or visible device 130 and then these addresses are stored 310 by the controller 110 in the controller memory 150 of fire alarm system 100. Next, these addresses are correlated and re-stored to the actual physical locations 315 of each device 120, 130, 140. The controller 110 now monitors 320 each detector 120 for alarm. Once an alarm state is detected a query is made as to the number or quantity of alarms 325, 335 detected. If multiple alarms 330 are detected, then a general alarm 335 is sounded via all devices in the fire alarm system 100. If only one alarm 325 is detected, then its sole address/location is determined 340 via the stored physical address within the control system. Once the physical address/location 345 is known, an assigned sequence number 350 is placed on the audible, visible device. A activate command is sent to such audible devices 140 and visible devices 130 based on the assigned sequence number in order to direct the safest egress from the emergency situation relative to a "hot zone" which may constitute for example, a fire or other dangerous event.

Although an example of the fire alarm system 100 is shown using fire detection devices, it will be appreciated that other detection schemes can be used. Also, although the fire alarm system 100 is useful to direct the egress from any potentially dangerous/hazardous location, it can also be used to detect poisonous gases and/or hazardous atmospheres due to biological agents and the like and to direct the egress to safety.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A fire alarm system, comprising:

a controller;

a plurality of detectors, wherein each of the plurality of detectors is assigned an address;

a plurality of audible devices, wherein each of the plurality of audible devices is assigned a sequence number;

a plurality of visible devices, wherein each of the plurality of visible device is assigned a sequence number, wherein said controller is electrically connected to the detectors and controls the audible devices and the visible devices, wherein the plurality of visible devices and the plurality of audible devices are configured to sequentially activate based on the sequence numbers and a command signal generated by the controller to direct an egress from a location, wherein the command signal is based on a detected fire hazard location; and assigning an address to each of a plurality of detectors, audible devices and visible devices.

2. The system of claim 1, wherein the controller further comprises a delay control.

3. The system of claim 1, wherein the plurality of detectors comprise at least one of smoke detectors and heat detectors.

4. The system of claim 1, wherein the plurality of audible devices comprise sirens.

5. The system of claim 1, wherein the plurality of visible devices comprise strobes.

6. The system of claim 1, wherein the controller compiles the command signal.

7. A method of controlling a fire alarm system, comprising:

detecting an alarm state for at least one of a plurality of detectors;

determining an address and physical location of the at least one of the plurality of detectors;

determining a location correlation of the at least one of the plurality of detectors in proximity to each of a plurality of audible devices and visible devices; and assigning a sequence number to each of the plurality of audible devices and visible devices, wherein a sequence of the sequence numbers of each of the plurality of audible devices and visible devices defines at least one of a plurality of exit paths from a predetermined location.

8. The method of claim 7, wherein each detector is comprises at least one of a smoke detector and a heat detector.

9. The method of claim 7, further comprising activating a general alarm using each of the plurality of audible devices and visible devices.

10. The method of claim 7, further comprising activating each of the plurality of audible devices and visible devices according to their sequence number.

11. The method of claim 10, wherein at least one of the plurality of audible devices comprises a siren and at least one of the plurality of visible devices comprises a strobe.

12. A fire alarm system, comprising:

means for detecting an alarm state for at least one of a plurality of detectors;

means for determining an address and physical location of the at least one of a plurality of detectors;

means for determining a location correlation of the at least one of a plurality of detectors in proximity to each of the plurality of audible devices and visible devices; and means for assigning a sequence number to each audible device and each visible device, wherein the sequence numbers of each of the plurality of audible devices and visible devices define at least one of a plurality of exit paths from a predetermined location.

13. The system of claim 12, further comprising:

means for assigning an address to each of a plurality of detectors, audible devices and visible devices;

means for storing said address of each detector, audible device and visible device; and means for correlating each stored addresses to a physical location.

14. The system of claim 12, wherein the means for assigning comprises an alarm controller.

15. The system of claim 12, further comprising:

means for activating a general alarm on each audible device and each visible device;

means for determining correlation of activated detector in proximity to each audible device and each visible device; and means for assigning a sequence number to each audible device and each visible device.

16. The system of claim 15, wherein the means for activating comprises a delay control.

17. The system of claim 12, further comprising means for activating each audible device and each visible device according to their sequence number.

18. The method of claim 7, further comprising assigning an address to each of a plurality of detectors, audible devices and visible devices.

19. The method of claim 18, further comprising storing the address of each of the plurality of detectors, audible devices, and visible devices.

20. The method of claim 18, further comprising correlating each address to a physical location.

* * * * *